US009359092B2

(12) United States Patent
Heuberger

(10) Patent No.: US 9,359,092 B2
(45) Date of Patent: Jun. 7, 2016

(54) DEVICE AND METHOD FOR PACKAGING PRODUCTS

(75) Inventor: Werner Heuberger, Baeretswil (CH)

(73) Assignee: FERAG AG, Hinwil (CH)

( * ) Notice: Subject to any disclaimer, the term of this patent is extended or adjusted under 35 U.S.C. 154(b) by 818 days.

(21) Appl. No.: 13/367,514

(22) Filed: Feb. 7, 2012

(65) Prior Publication Data

US 2012/0198796 A1 Aug. 9, 2012

(30) Foreign Application Priority Data

Feb. 9, 2011 (CH) ..... 235/11

(51) Int. Cl.
*B65B 31/04* (2006.01)
*B65B 9/06* (2012.01)

(52) U.S. Cl.
CPC ..... *B65B 9/06* (2013.01); *B65B 31/043* (2013.01); *B65B 31/046* (2013.01)

(58) Field of Classification Search
CPC .... B65B 31/04; B65B 31/046; B65B 31/043; B65B 31/041; B65B 31/044; B65B 31/06; B65B 31/08; B65B 9/06
USPC ..... 53/550
See application file for complete search history.

(56) References Cited

U.S. PATENT DOCUMENTS

| | | | | |
|---|---|---|---|---|
| 3,274,746 | A * | 9/1966 | James et al. | 53/433 |
| 3,636,678 | A * | 1/1972 | Maros et al. | 53/412 |
| 3,958,390 | A * | 5/1976 | Pringle et al. | 53/433 |
| 3,973,474 | A | 8/1976 | Auckenthaler | |
| 4,170,863 | A | 10/1979 | Schwaaz | |
| 4,272,944 | A * | 6/1981 | Suga | 53/511 |
| 5,311,726 | A * | 5/1994 | Rauscher et al. | 53/511 |
| 5,706,635 | A * | 1/1998 | Simmons | 53/511 |
| 7,757,461 | B2 | 7/2010 | Honegger | |
| 2010/0257820 | A1 * | 10/2010 | Doll et al. | 53/433 |

FOREIGN PATENT DOCUMENTS

| | | |
|---|---|---|
| CH | 636568 | 6/1983 |
| DE | 1262867 | 3/1968 |
| DE | 1511627 | 10/1969 |
| DE | 2457533 | 8/1975 |
| DE | 2800548 | 7/1979 |

(Continued)

OTHER PUBLICATIONS

Swiss Federal Institute of Intellectual Property (search report); Apr. 13, 2011.

(Continued)

*Primary Examiner* — Andrew M Tecco
(74) *Attorney, Agent, or Firm* — Rankin, Hill & Clark LLP

(57) ABSTRACT

A device for packaging preferably two-dimensional products is designed for forming a bag-like tube by way of a longitudinal connection device, from a web of packaging material. The bag-like tube, with respect to a conveying direction of the packaging material, is open in a region in front of the longitudinal connection device and is closed in the region after the longitudinal connection device. The device includes a suction device which leads into the still open bag-like tube, and in the closed region includes a suction opening, through which gas can be sucked out of the region after the longitudinal connection device, out of the bag-like tube and through the suction device.

17 Claims, 8 Drawing Sheets

(56) References Cited

FOREIGN PATENT DOCUMENTS

| | | |
|---|---|---|
| DE | 19918253 | 10/2000 |
| DE | 10015628 | 10/2001 |
| DE | 10118389 | 10/2002 |
| DE | 10123557 | 11/2002 |
| DE | 20202487 | 7/2003 |
| DE | 10232107 | 2/2004 |
| DE | 102007049703 | 4/2009 |
| EP | 0721886 | 7/1996 |
| EP | 2177438 | 4/2010 |
| EP | 2241506 | 10/2010 |
| WO | 9518748 | 7/1995 |
| WO | 0149566 | 7/2001 |
| WO | 2005/118400 | 12/2005 |
| WO | 2005118402 | 12/2005 |
| WO | 2007147269 | 12/2007 |

OTHER PUBLICATIONS

Partial European Search Report dated Apr. 24, 2012, two pages.

* cited by examiner

Cross-section A-A

Cross-section A-A

DEVICE AND METHOD FOR PACKAGING PRODUCTS

BACKGROUND OF THE INVENTION

1. Field of the Invention

The invention is related to the field of conveying technology and packaging technology. It relates to a device and to a method for packaging products, according to the preamble of the respective independent claims.

2. Description of Related Art

A device for film-wrapping individually conveyed objects is described in WO 2005/118400 (corresponding to U.S. Pat. No. 7,757,461). The objects are preferably flat products, for example printed products such as newspapers, brochures, books etc. or stacks of these. If such products are welded into films, then the films as a rule are perforated and gas-permeable due to this. In certain circumstances however, waterproof and thus also airtight packaging is demanded, in order for example to protect the packaged products from environmental influences such as moisture. Then, however, the problem arises of the packaging behaving like a slightly inflated cushion and by way of this being more difficult to handle and, for example, being poorly stackable.

DE 202 02 487 U1, DE 102 32 107 A1 and DE 100 15 628 A1 show the evacuation of foodstuffs packaging. This, however, is not very suitable for high product speeds, as are demanded with the manufacture of printed products.

DE 10 2007 049 703 A1 describes a shaping shoulder for shaping a film bag-like tube. A shoulder wall is provided with openings for sucking the film material against the shoulder wall. By way of this, the film bears tightly on the shoulder wall and runs without waves or creases.

It is therefore the object of the invention, to provide a device and a method for packaging products of the initially mentioned type, which remedy the disadvantages mentioned above and are suitable for high product speeds.

BRIEF SUMMARY OF THE INVENTION

These objects are achieved by a device and a method for packaging products, with the features of the respective independent patent claims.

The device for packaging products, for example two-dimensional products or products arranged over one another, is designed for forming a bag-like tube (this could also be described as a longitudinally directed, flexible envelope) by way of a longitudinal connection device, from a web of packaging material. Thereby, the bag-like tube with respect to a conveying direction of the packaging material is open in a region in front of the longitudinal connection device and is closed in a region after the longitudinal connection device. The device comprises a suction device which in the region in front of the longitudinal connection device leads into the bag-like tube which is still open, and in the region after the longitudinal connection device comprises at least one suction opening through which gas, preferably air, can be sucked away out of the region after the longitudinal connection device out of the bag-like tube and through the suction device. Thereby in the device, either a section of the suction channel cooperates with the longitudinal connection device for forming the longitudinal connection, or however an arm leads into the bag-like tube and subsequently extends in the conveying direction up to the suction opening, wherein a region of the suction element which cooperates with the longitudinal connection device for forming the longitudinal connection, is arranged outside the bag-like tube.

If several products are packaged, these can be several flat products over one another, for example several printed products of the same or different format. However, also one or more flat products can be packaged together with non-flat products or objects, such as sample goods.

The products can be applied onto one another as stacks, but they can also be arranged over one another and offset, e.g. in a sequence of products which is similar to roof tiles.

The products can also be arranged in one another or partly in one another, for example by way of them being inserted into one another.

The product or the products which, be it individually, as stacks on one another or offset etc., are present in the same pocket of packaging material, are indicated as a packaging unit. Successive packaging units are, thus, separated from one another in each case by way of transverse weldings. It is also possible for several streams of packaging units to be supplied in the conveying direction parallel, next to one another, and be conveyed into the bag-like tube. These can be separated from one another transversely to the conveying direction by way of one or more further longitudinal welding devices.

With regard to the characterisation that the bag-like tube is open or closed, what is meant in the context of the present application is that the bag-like tube in its cross section, thus along its periphery, is open or closed. If the outer sides or web sections of the web of the packaging material are merely applied over one another, thus not connected to one another, then the bag-like tube is still indicated as open. If subsequently these web sections are connected to one another e.g. by way of welding or bonding, then the bag-like tube is indicated as being closed.

With this, an evacuation of gas, preferably air, out of the region after the longitudinal connection, thus in the region of the closed bag-like tube, is possible. Subsequently, the bag-like tube can be subdivided by way of transverse weldings into individual sections with products. Thus the connections of the packaging material which are created by the longitudinal connection device and the transverse welding device are preferably gastight. Thanks to the suction device, less gas, in particular air, is located in the thus arising sections and the thus packaged products can be better handled and stacked. For example, product speeds of more that 25,000 individually welded products per hour can be achieved.

The web of packaging material is typically initially flat and is supplied from a roll and is folded in the manner known per se in a bag-like tube formation device, into a bag-like tube. Thereby, the two lateral—seen with respect to the conveying direction or longitudinal direction of the web—edges of the web are led or applied on one another.

Thereby, in the invention, a section of the suction channel cooperates with the longitudinal connection device for forming a longitudinal connection. By way of this therefore, the suction channel has a double function, by which means the number of elements in the region of the bag-like tube formation and of the closed bag-like tube is reduced and thus collisions with conveyed products are avoided.

Instead of a section of the suction channel cooperating with the longitudinal connection device for forming the longitudinal connection, in the invention however an arm can also lead into the bag-like tube and subsequently extend in the conveying direction up to the suction opening. A region of the suction element which cooperates with the longitudinal connection device for forming the longitudinal connection is thereby arranged outside the bag-like tube.

Preferably, the following sections along the bag-like tube are present in the device:

An introduction section, in which the suction device with an arm leads into the bag-like tube which is still open.

A unification section, in which a first edge section and a second edge section of the web are led onto one another. The two edge sections are located at the oppositely lying edges of the web and run parallel to the longitudinal direction or conveying direction of the web.

A connection section, in which the edge sections are connected to one another by the longitudinal connection device, for example by way of welding or bonding.

A suction section, in which the suction opening of the suction device is present.

The parts of the suction device which are arranged in the bag-like tube of the packaging material or which lead into the bag-like tube, are preferably designed in a flat manner, with preferably a height of less than three cm or less than two cm. This, therefore, means that these parts at no location are thicker than this height. With this, the shape of the suction device is adapted to the packaging of flat products, in particular printed products, into a flatly pressed bag-like tube.

The parts of the suction device which are arranged in the bag-like tube of the packaging material or which lead into the bag-like tube, are preferably at least partly hollow for leading through the sucked gas. These parts themselves therefore form the channels or conduits for sucking gas. Separate conduits which could inhibit the movement of the film are therefore done away with.

An optional pressing-on device, for example with pressing-on rollers, primarily presses the film bag-like tube together and against the products, and by way of this supports the sucking of the air or generally of a gas. It is preferably arranged directly subsequent to the suction section.

An optional pressing device is preferably envisaged for products which can be pressed together, in particular compressed, for example printed products such as newspapers. It presses the products onto the conveying path, holds the products in a flat manner and as the case may be also additionally compresses the products shortly before the transverse welding device, so that after the transverse welding, even less gas is present in the closed-off individual packaging. If the compressed, intrinsically partly elastic products expand again after the transverse welding, they are held together by the welded packaging. The pressing device is arranged preferably directly subsequent to the pressing-on device or, if no pressing-on device is present, directly subsequent to the suction section.

Air or gas is pressed or displaced out of the bag-like tube by way of the pressing-on device as well as by the pressing device.

Preferably, the installation section for packaging the products is designed and arranged such that the conveying direction of the products and of the packaging material is horizontal.

Preferably, the products are actively conveyed and fed. By way of this, the speed on feeding the products is not limited to the acceleration due to gravitational force.

The longitudinal connection device is preferably a welding device, in particular a longitudinal welding element for longitudinally welding thermoplastic packaging material, in particular a plastic film. Alternatively, the longitudinal connection device is a bonding device.

In contrast to many packaging installations for foodstuffs, no pourable product is packaged, but the packaged products are unit loads or goods. Likewise, a strong vacuum in the packaged product does not need to be present, in contrast to many packaging installations for foodstuffs. It is sufficient when the packaged products remain flat and can be handled well by way of this, in particular are stackable. If no strong vacuum is present in the packaging, but a certain quantity of residual air or gas, then the products can be displaced to one another in the packaging. By way of this, the content of the packaging can be examined, e.g. by the end customer.

The bag-like tube formation and packaging device is suitable for packaging products which are not flat, in particular also foodstuffs which are present as unit loads.

The gas sucked from the packaging can be air, or a protective gas, according to the type of packaged products.

In trials, is has been found that the sucking-away of the gas and a vacuum in the bag-like tube, as an additional use, improves the connection of the web sections lying over one another, in the region of the transverse welding. This on the one hand is because the bag-like tube itself is pulled together due to the vacuum in the bag-like tube, and on the other hand because the products are pressed together. With this, again higher production speeds can be realised.

In a further embodiment of the method, the packaging material is not gastight, for example by way of it being perforated. Although a certain amount of gas can flow in on account of this, a contraction of the evacuated packaging material takes place and greater product speeds, as if without sucking-away can be realised.

Moreover, a friction between the products is also increased by way of air or gas being sucked out between the products and by way of the evacuated packaging holding the products together. By way of this, again the products are fixed better in the packaging and likewise permit a higher production speed.

In another embodiment, the volume flow of the suction device can be regulable. With this, it can be adapted according to the production speed, or for example can be reduced with the use of sensitive packaging materials.

In a further embodiment of the invention which can also be considered and realised as an independent invention, damping rollers are present, which are inherently compliant, preferably elastic and damping, and the longitudinal welding device and/or the transverse welding device lie opposite with respect to the bag-like tube of the packaging materials with products, wherein welding elements such as welding bars, on welding, exert a force through the bag-like tube and, as the case may be, also through a conveying means, for example a conveyor belt, against the damping rollers, wherein a deflection of the bag-like tube with the products and, as the case may be, also of the conveyor belt, is damped by the damping rollers.

By way of this, undesired oscillations and resonances of the bag-like tube and/or of the conveying means are reduced or eliminated, just as vibrations and displacements of the products in a packaging unit. By way of this, in turn the quality of the longitudinal welding or the transverse welding is improved. In contrast to rollers which are inherently essentially rigid and rotate about a moving, resiliently mounted axis or pivot, the damping rollers are inherently compliant, preferably elastic and damping, by which means a particularly efficient damping takes place. The axis or pivot of the damping rollers is thus not movably mounted, i.e. it cannot displace in a direction radial to the axis or pivot.

According to an independent invention, thus a transverse welding device comprises damping rollers as described above.

In the method for packaging preferably two-dimensional products, thus a bag-like tube is formed from a web of packaging material, wherein the bag-like tube with respect to a conveying direction of the packaging material, is open in a region in front of a longitudinal connection device and is closed in a region after the longitudinal connection device.

Thereby, a suction device in the region in front of the longitudinal connection device leads into the bag-like tube which is still open along its periphery, and in the region after the longitudinal connection device comprises at least one suction opening, with which the suction device sucks gas from the region after the longitudinal connection device out of the bag-like tube. In the method thereby, either a section of the suction channel cooperates with the longitudinal connection device for forming the longitudinal connection, or an arm leads into the bag-like tube and subsequently extends in the conveying direction up to the suction opening, wherein a region of the suction element which is arranged outside the bag-like tube, cooperates with the longitudinal connection device for forming the longitudinal connection.

Further preferred embodiments are to be deduced from the dependent patent claims. Thereby, the features of the method claims, where it makes sense, can be combined with the device claims and vice versa.

BRIEF DESCRIPTION OF THE DRAWINGS

The subject matter of the invention is explained in more detail hereinafter by way of preferred embodiment examples which are represented in the accompanying drawings. In each case are shown schematically in.

Basically, the same parts in the figures are provided with the same reference numerals.

DETAILED DESCRIPTION OF THE INVENTION

Figure 1:
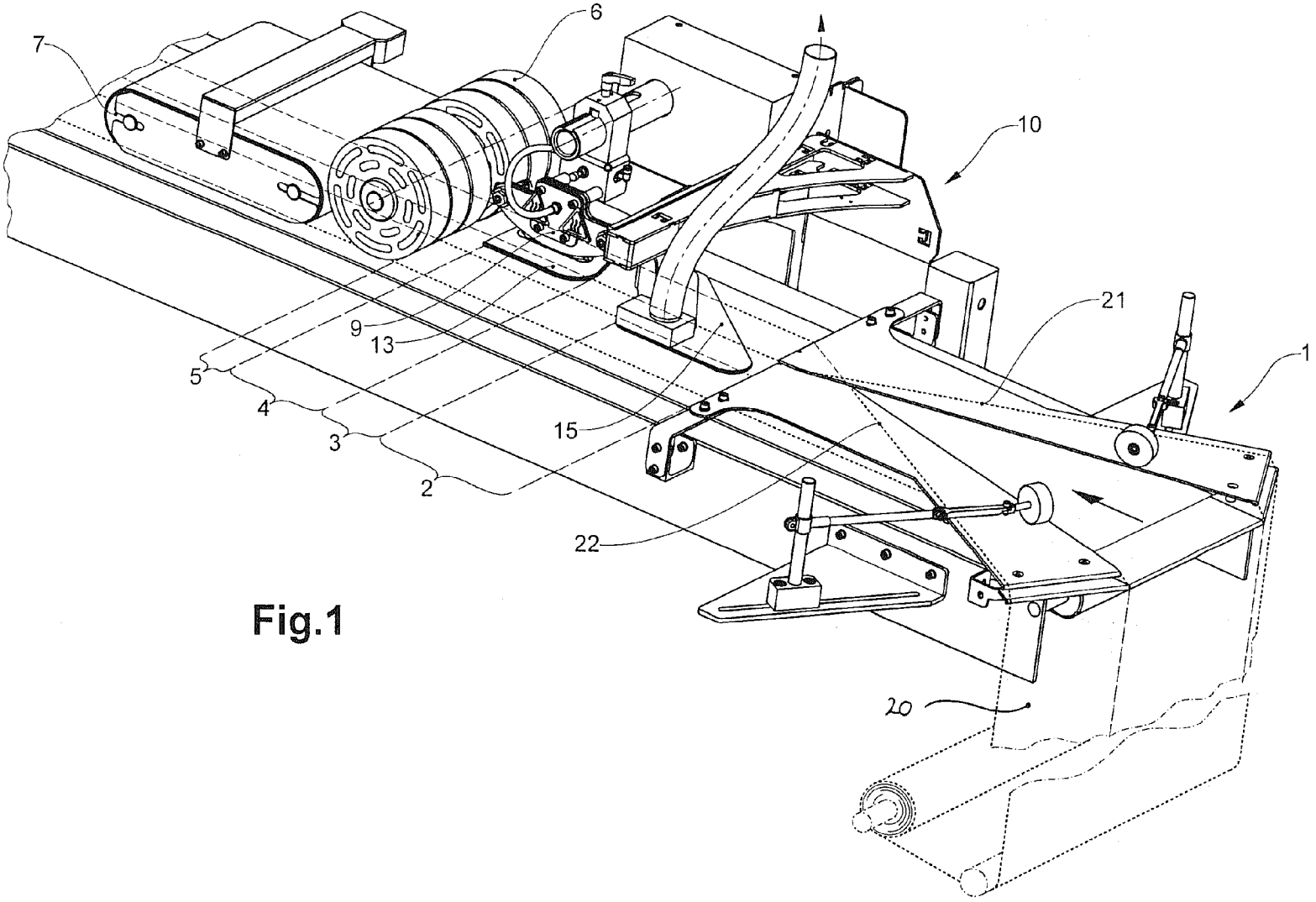
FIG. 1 an overview of an installation section with a suction device.
Figure 2:
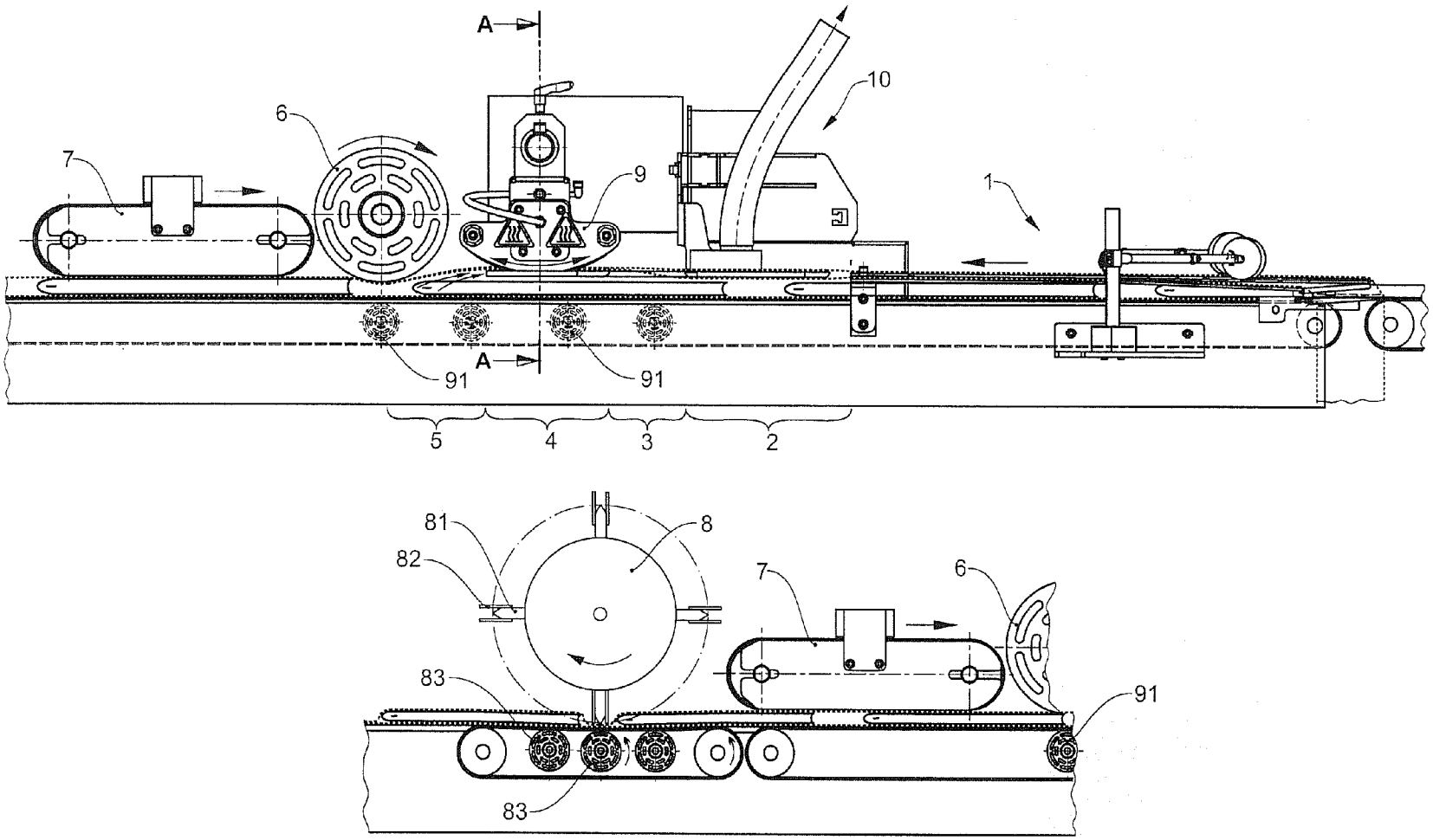
FIG. 2 a lateral view of the same, wherein the view is divided into two part views for an improved representation.

FIG. 1 shows an overview and FIG. 2 a lateral view of an installation section with a bag-like tube formation device 1, with a longitudinal welding device with a suction device 10. A film 20 runs through the installation section in the arrow direction. It is supplied as a film web and is folded into a bag-like tube, thereby encompasses a stream of singularised products 24 present as unit loads, is welded in the longitudinal direction, thus in the conveying direction and subsequently welded in the transverse direction between the products 24. Gas, typically air, is sucked out between the longitudinal welding and the transverse welding in the film bag-like tube by way of the suction device 10. A subsequently arranged transverse welding device 8 (only represented in FIG. 2) forms closed, basically gas-tight sections of the film bag-like tube. These are separated from one another into individual packages either with the transverse welding itself or later.

For supporting the suction effect, in a preferred embodiment of the invention, a pressing-on device, for example with pressing-on rollers 6 of foam can be present, and/or a pressing device, for example with a pressing belt 7 which by way of a weight force and/or spring force holds down the bag-like tube with the products 24 lying therein and, as the case may be, also presses it together. The pressing-on device and pressing device are preferably arranged subsequently to the suction section 5, but not necessarily directly subsequently.

As is visible in FIG. 2, damping rollers 83 are arranged in the region of the transverse welding device 8. They support a conveyor belt with products 24 transported thereon, against a force which the transverse welding device 8 exerts on the bag-like tube with the products 24. The transverse welding device 8 comprises welding bars 81 with holding-down means 82. The holding-down means 82 stabilise the film webs or the bag-like tube during the welding procedure. Thereby, the welding bar 81 and the holding down means 82 press against the bag-like tube and the conveyor belt. The conveyor belt moves against the damping rollers 83, wherein the movement of the conveyor belt and of the bag-like tube with the products is damped by the damping rollers 83.

Corresponding damping rollers are disclosed in EP 2 230 203 A1 of the same applicant and there are indicated as a support element or support roller. The characteristics of such rollers are included in the present application by way of reference.

Respective damping rollers 91 of the longitudinal welding device can also be arranged in the region of the longitudinal welding device.

Figure 3:
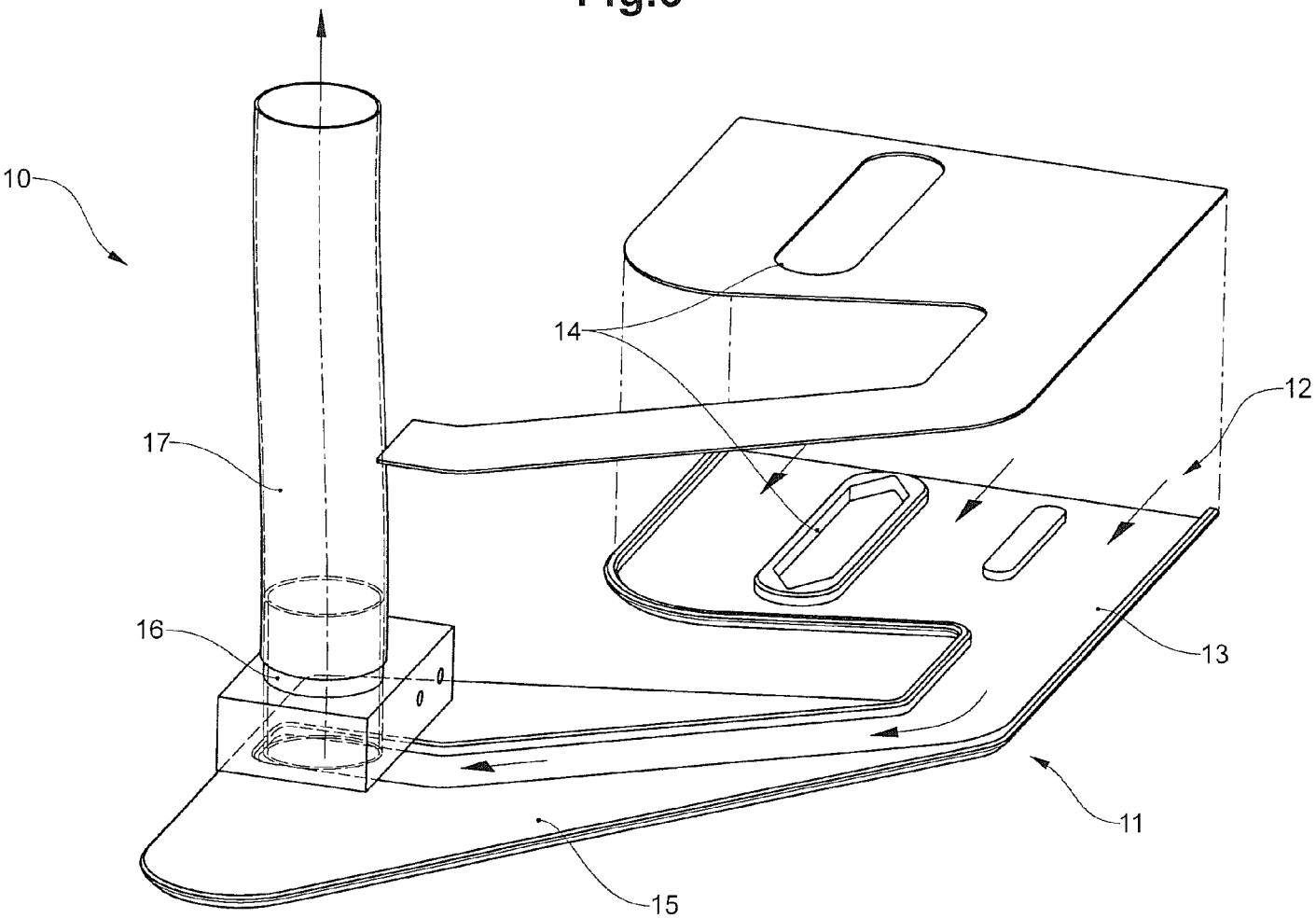
FIG. 3 a suction device.

FIG. 3 shows a suction device 10 in a partly exploded view. The suction device 10 itself comprises a suction element 11 which at a connection union 16 is connected via a suction conduit 17 to a (not drawn) suction pump. The suction element 11 is preferably designed in an essentially flat manner and comprises an arm 15 and a suction channel 13. The suction channel 13 ends in a suction opening 12. Preferably, the suction channel 13 has a welding region 14 which cooperates with a longitudinal welding device, in particular with a longitudinal welding bow 9 for longitudinally welding the film 20. The welding region 14 can be a recess in the suction channel 13 or an opening going through the suction channel 13.

Figure 4:
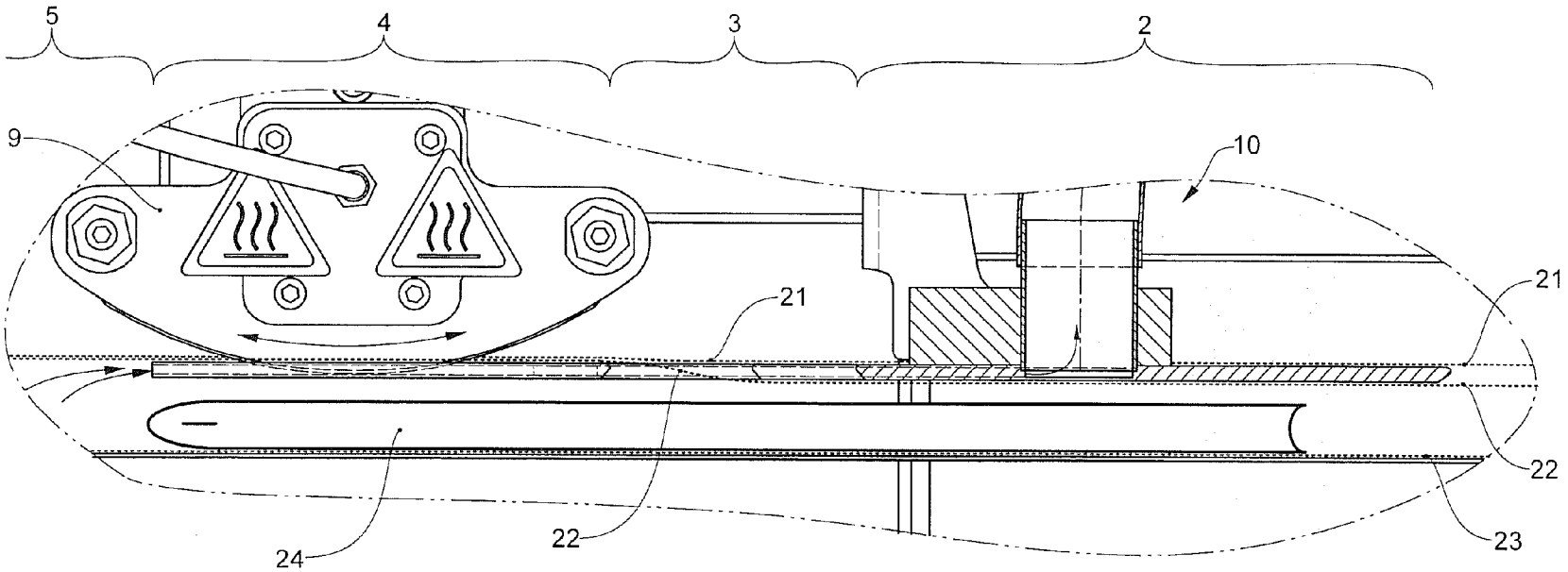
FIG. 4 a detailed view of the suction device in combination with a longitudinal welding device.
Figure 5:
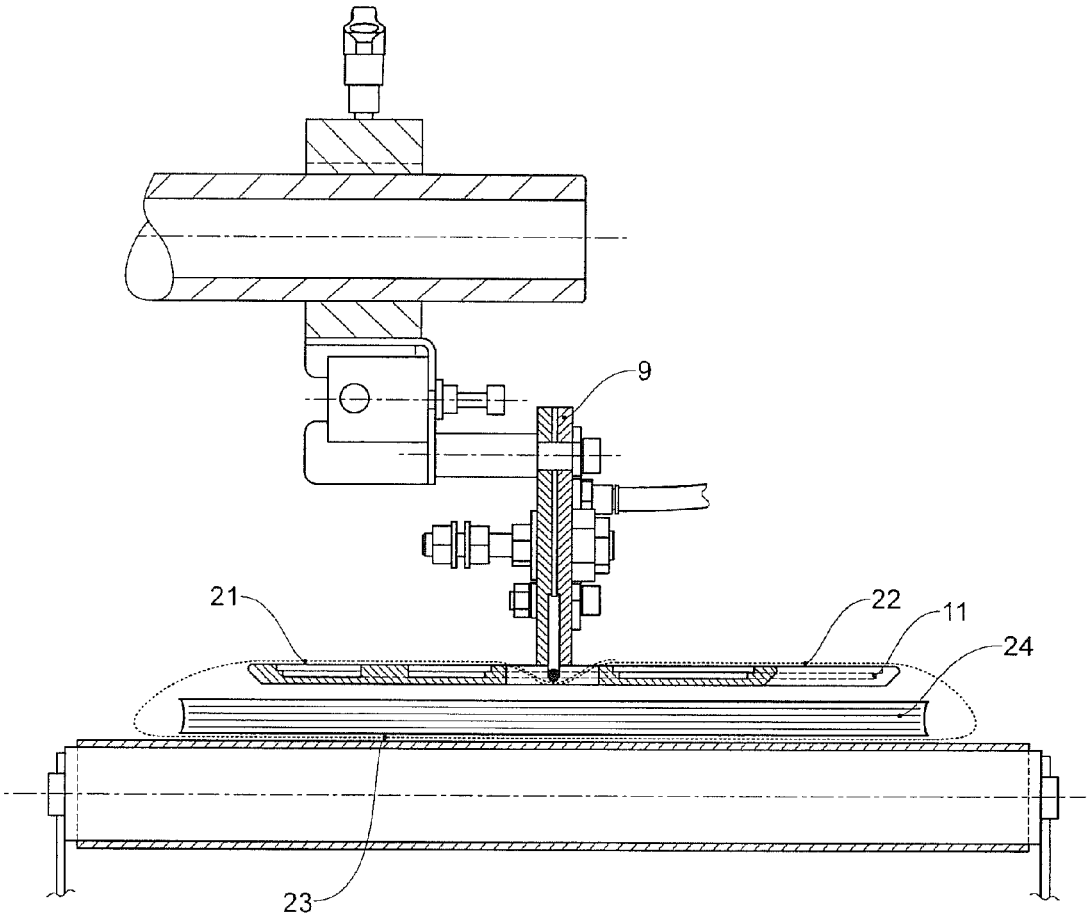
FIG. 5 a cross section through the previous view.

Hereinafter, the arrangement of the suction device 10 with respect to the film 20 and its manner of functioning are explained by way of FIGS. 4 and 5. In the bag-like tube formation device 1, the film 20 is folded in the longitudinal direction into a bag-like tube, wherein the products 24 are conveyed onto the film 20 and into the bag-like tube. On leaving the bag-like tube formation device 1, thus the products 24 are at their upper side and roughly in the middle of the flatly widened-out bag-like tube covered by a first edge section or web section 21 and a second edge section or web section 22 of the film 20 and the products 24 lie on a third web section 23. These web sections run in the longitudinal direction of the film 20. Thereby, the first web section 21 lies above the second web section 22. The inner side of the first web section 21 lies on the outer side of the second web sections 22. In other words, the inner side of the film 20 is applied onto the outer side and subsequently connected.

The film bag-like tube with the products 24, subsequently to the bag-like tube formation device 1, is conveyed in the conveying direction through an introduction section 2, a unification section 3, a connection section 4 and a suction section 5 of the device.

In the introduction section 2, the first web section 21 runs above and the second web section 22 below the arm 15. The arm 15 of the suction element 11 thus leads into the still open bag-like tube.

In the unification section 3, the second web section 22 is led upwards, or with respect to the bag-like tube, is led outwards and against the first web section 21. The second web section 22 thus comes into contact with the first web section 21. The web is closed by way of this, but not yet welded. In the unification section 3, the arm 15 extends along the conveying device. The length of the unification section 3 is directed to the conveying speed and to the robustness and flexibility of the film material.

In the connection section 4, the first web section 21 and the second web section 22 both lie above, or, with respect to the bag-like tube, outside the suction channel 13 of the suction element 11, and are in contact with one another. The suction channel 13 thus lies completely within the bag-like tube. In one region of the suction channel 13, the suction channel 13 is designed as a welding region 14. The welding region 14 is a recess or an opening traversing the suction channel 13, into which layers of a packaging material lying against one another can be pressed by way of the longitudinal connection device or the longitudinal welding bow 9. The longitudinal welding bow 9 presses the two first and second web sections 21, 22 running above or outside the suction channel 13, a little into the welding region 14, which results in a necessary counter-force against the longitudinal welding bow 9, and welds them to one another. The longitudinal welding bow 9 thereby preferably executes a rocking movement, as is indicated in FIG. 4 by a double a row.

The suction channel 13 extends in its width over at least a quarter or half or three quarters of the width of the flatly pressed film bag-like tube, in order to be able to evacuate this as effectively as possible. The evacuation or sucking-away of gas is effected therefore—in an as wide as possible region of the film bag-like tube—in the suction section 5, in which the film is welded in the longitudinal direction into a closed bag-like tube. Preferably, the suction opening 12 is open in the direction of the conveying, thus on operation of the device sucks gas out of the bag-like tube opposite to the conveying direction.

As already explained, the film is pressed together by way of the subsequent pressing-on rollers 6 and the pressing belt 7 and the sucking-away is supported by way of this, and the products 24 are compressed in front of the transverse welding device 8.

Figure 6:
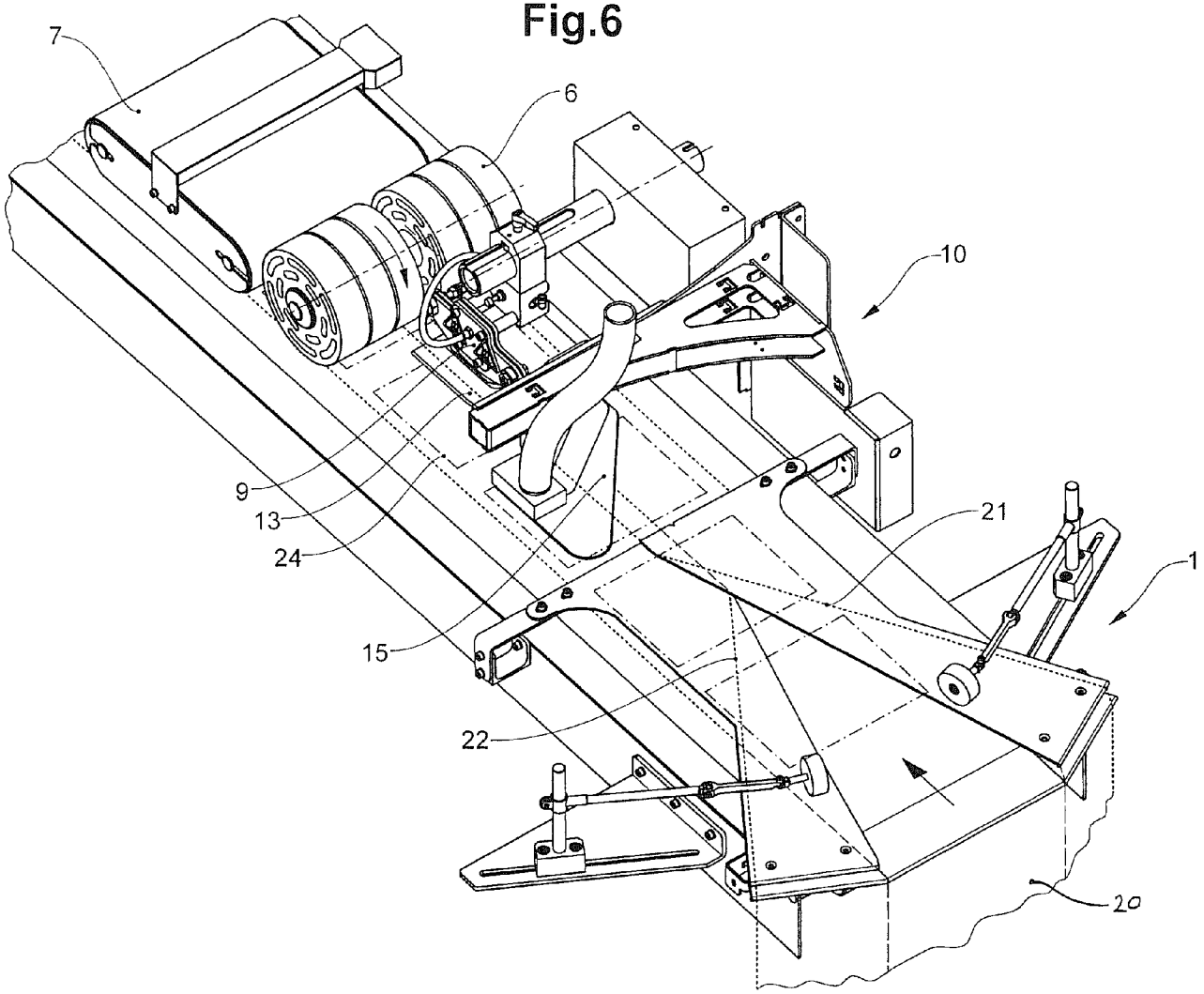
FIG. 6 a further overview.

FIG. 6 shows a further overview. Amongst other things, it is visible how the products 24 are conveyed in a singularised manner, and how the pressing-on rollers 6 act over the complete width of the flatly pressed bag-like tube.

Figure 7:
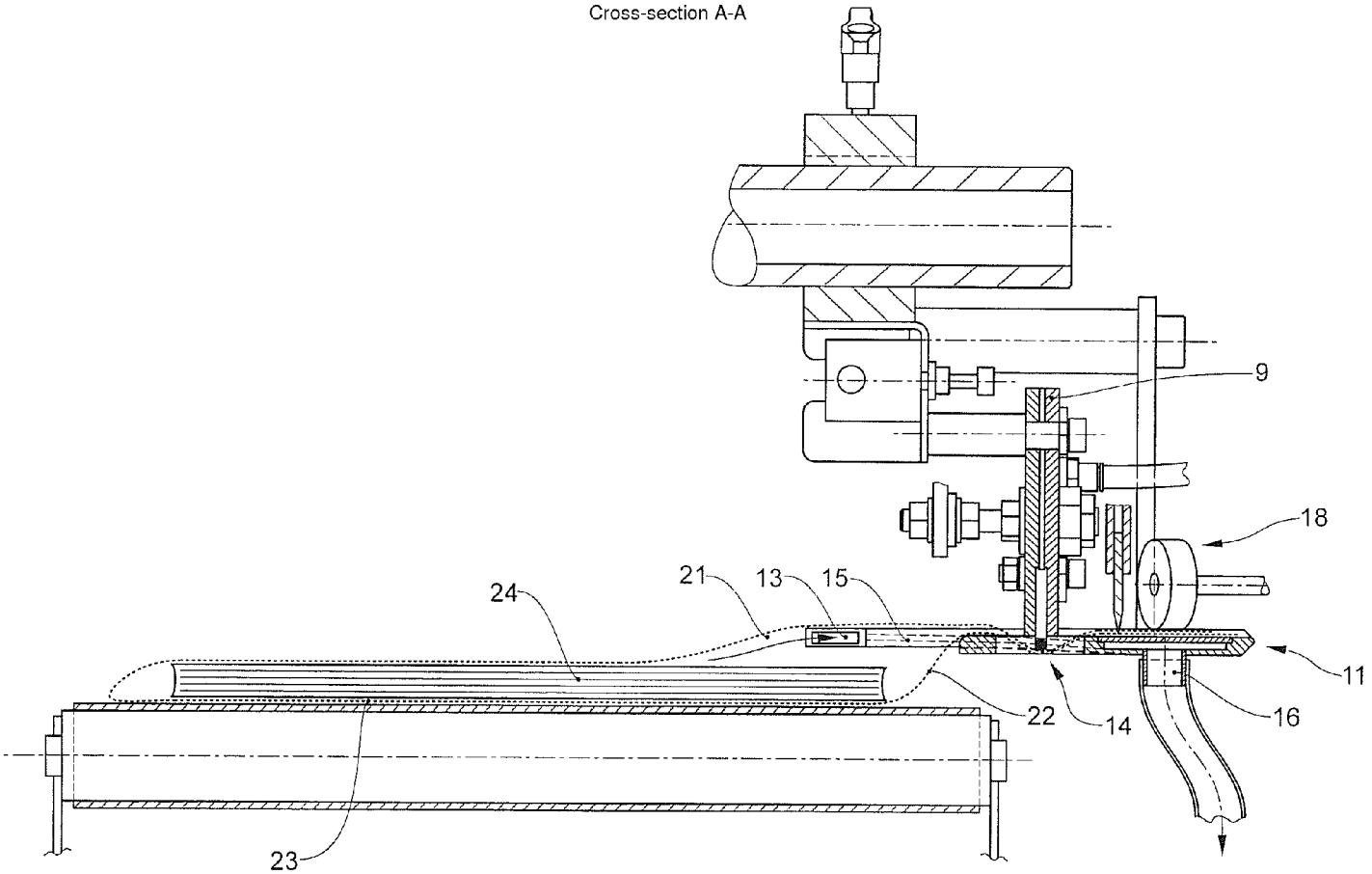
FIG. 7 a cross section through a suction device together with a lateral longitudinal connection device.
Figure 8:
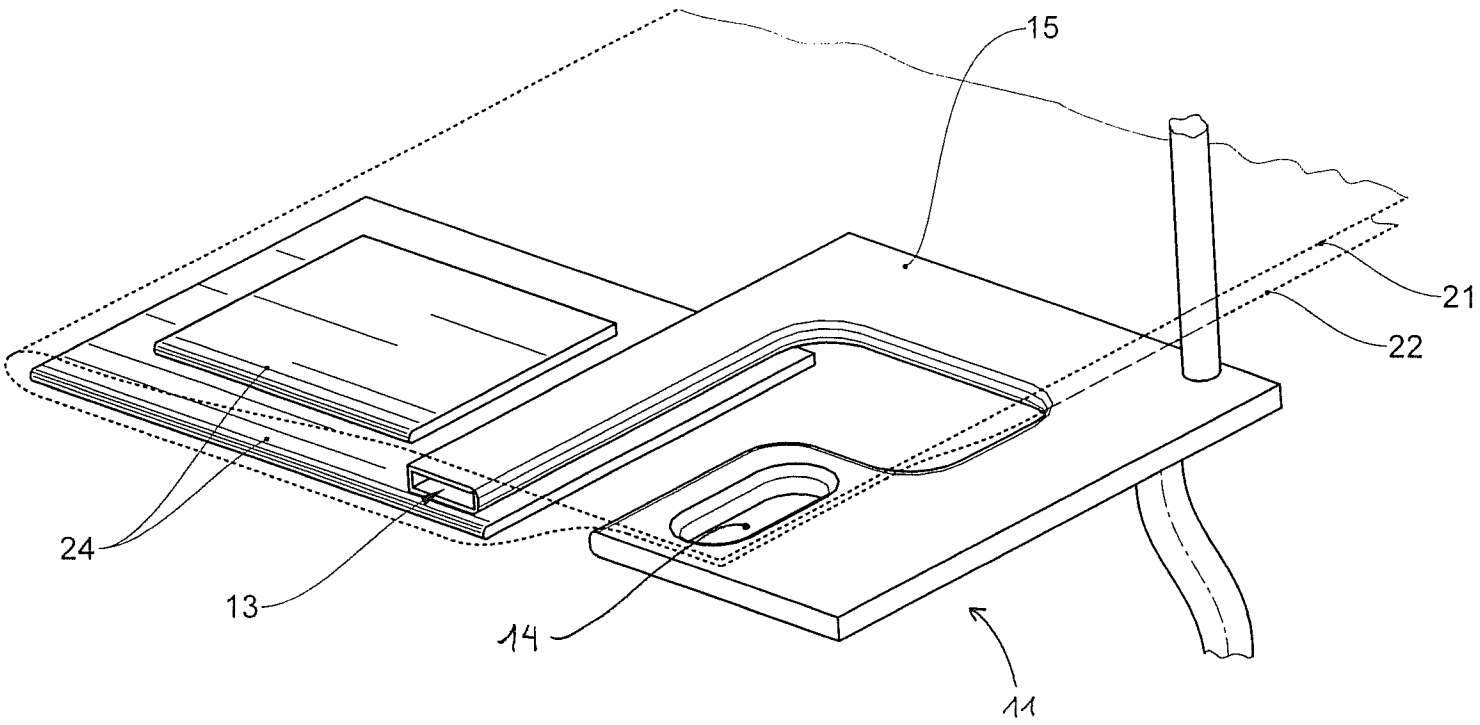
FIG. 8 a view of the suction device of FIG. 7.

FIG. 7 shows a cross section through a suction device together with a lateral longitudinal connection device, and FIG. 8 a view of the essential parts. The conveying direction leads to the viewer. The bag-like tube is formed by way of applying the first web section 21 and the second web section 22 onto one another, wherein the two inner sides (thus the same side of the film 20) lie on one another and are subsequently connected. The arm 15 of the suction element 11 leads (in FIG. 7 behind the plane of the drawing, which leads through the longitudinal welding bow 9) laterally between the two web sections 21, 22 into the bag-like tube which is still open, and then preferably a little further in the conveying direction (in the direction of the viewer in FIG. 7). Viewed along the conveying direction, the first web section 21 runs above the arm 15, and the second web section 22 below the arm 15, in the region of the arm 15. Subsequently to the arm 15, the second web section 22 is led upwards. Both web sections 21, 22 run above the welding region 14, in the region of the longitudinal welding bow 9 and of the welding region 14.

A cutting device 18 with a roller for cutting and leading away packaging material lying outside the welding seam is arranged to the right of the longitudinal welding bow 9 on the outer side with respect to the newly formed bag-like tube.

The invention claimed is:

1. A device for packaging products which is designed for forming a bag-like tube by way of a longitudinal connection device, from a web of packaging material, wherein the bag-like tube, with respect to a conveying direction of the packaging material, is open in a region in front of the longitudinal connection device and is closed in a region after the longitudinal connection device, the device comprising:

a suction device comprising a suction channel and at least one suction opening, said suction device, in the region in front of the longitudinal connection device, leads into the still open bag-like tube, said at least one suction opening, through which gas can be drawn out of the region after the longitudinal connection device, through the suction channel, and out of the bag-like tube, being provided in the region after the longitudinal connection device, wherein a section of the suction channel cooperates with the longitudinal connection device to form a longitudinal connection in the web of packaging material and thereby form the bag-like tube, wherein the section of the suction channel defines an enclosed hole in the suction channel into which layers of the packaging material, which lie against one another, can be pressed by the longitudinal connection device to form the longitudinal connection.

2. The device according to claim 1, wherein in an introduction section, the suction device with an arm leads into the still open bag-like tube, in a unification section, a first edge section and a second end section of the web are led on one another, in a connection section, the edge sections are connected to one another by way of the longitudinal connection device and in a suction section, the suction opening of the suction device is present.

3. The device according to claim 2, wherein a pressing-on device for pressing together the bag-like tube, in the conveying direction is arranged following the suction section.

4. The device according to claim 2, wherein a pressing device for pressing products present in the bag-like tube and for displacing gas out of the bag-like tube, in the conveying direction is arranged following the suction section.

5. The device according to claim 4, wherein the connections of the packaging material created by the longitudinal connection device and the transverse welding device are gas-tight.

6. The device according to claim 2, wherein a transverse welding device for forming a welding transverse to the conveying direction of the bag-like tube is arranged following the suction section.

7. The device according to claim 6, wherein the connections of the packaging material created by the longitudinal connection device and the transverse welding device are gas-tight.

8. The device according to claim 2, wherein a transverse welding device for forming a welding transverse to the conveying direction of the bag-like tube is arranged following the suction section.

9. The device according to claim 1, wherein the suction opening is open towards the conveying direction, thus in operation, the device draws gas in a direction opposite to the conveying direction, out of the bag-like tube of the packaging material.

10. The device according to claim 1, wherein parts of the suction device, which are arranged in the bag-like tube of the packaging material or which lead into the bag-like tube, are designed in a flat manner.

11. The device according to claim 1, wherein the longitudinal connection device is a longitudinal welding element for longitudinally welding the packaging material.

12. A device for packaging products which is designed for forming a bag-like tube by way of a longitudinal connection device, from a web of packaging material, wherein the bag-like tube, with respect to a conveying direction of the packaging material, is open in a region in front of the longitudinal connection device and is closed in a region after the longitudinal connection device, the device comprising:

a suction device comprising a suction channel and at least one suction opening, said suction device, in the region in front of the longitudinal connection device, leads into the still open bag-like tube, said at least one suction opening, through which gas can be drawn out of the region after the longitudinal connection device, through the suction channel, and out of the bag-like tube, being provided in the region after the longitudinal connection device, wherein a section of the suction channel includes an enclosed hole into which layers of the packaging material, which lie against one another, are pressed by the longitudinal connection device to form a longitudinal connection in the web of packaging material and thereby form the bag-like body.

13. The device according to claim 12, wherein in an introduction section, the suction device with an arm leads into the still open bag-like tube, in a unification section, a first edge section and a second end section of the web are led on one another, in a connection section, the edge sections are connected to one another by way of the longitudinal connection device and in a suction section, the suction opening of the suction device is present.

14. The device according to claim 13, wherein a pressing-on device for pressing together the bag-like tube, in the conveying direction is arranged following the suction section.

15. The device according to claim 13, wherein a pressing device for pressing products present in the bag-like tube and for displacing gas out of the bag-like tube, in the conveying direction is arranged following the suction section.

16. The device according to claim 12, wherein the suction opening is open towards the conveying direction, thus in operation, the device draws gas in a direction opposite to the conveying direction, out of the bag-like tube of the packaging material.

17. The device according to claim 12, wherein parts of the suction device, which are arranged in the bag-like tube of the packaging material or which lead into the bag-like tube, are designed in a flat manner.

* * * * *